US010926281B2

(12) United States Patent
Rossignol

(10) Patent No.: US 10,926,281 B2
(45) Date of Patent: Feb. 23, 2021

(54) PUMP FOR COSMETIC PRODUCT VIAL, SEALED UNDER LOW-PRESSURE CONDITIONS

(71) Applicant: Albea Services, Gennevilliers (FR)

(72) Inventor: Eric Rossignol, Chalon sur Saone (FR)

(73) Assignee: ALBEA LE TREPORT, Le Treport (FR)

( * ) Notice: Subject to any disclaimer, the term of this patent is extended or adjusted under 35 U.S.C. 154(b) by 0 days.

(21) Appl. No.: 16/726,509

(22) Filed: Dec. 24, 2019

(65) Prior Publication Data

US 2020/0197967 A1 Jun. 25, 2020

(30) Foreign Application Priority Data

Dec. 24, 2018 (FR) ..... 1874127

(51) Int. Cl.
*B05B 11/00* (2006.01)
*F04B 43/00* (2006.01)

(52) U.S. Cl.
CPC ..... *B05B 11/3028* (2013.01); *B05B 11/305* (2013.01); *B05B 11/3069* (2013.01); *F04B 43/0063* (2013.01)

(58) Field of Classification Search
CPC ..... B05B 11/3061; B05B 11/3033; B05B 11/304; B05B 11/3028; B05B 11/3035; B05B 11/3064; B05B 11/305; B05B 11/3069; B05B 9/0413; F04B 9/14; F04B 43/0063
See application file for complete search history.

(56) References Cited

U.S. PATENT DOCUMENTS 2,702,147 A * 2/1955 Brown ..... F04B 53/102 222/207
2,954,048 A * 9/1960 Rychlik ..... F04B 43/0063 137/512.15
3,130,877 A * 4/1964 Miller ..... F04B 53/1092 222/207
3,362,343 A * 1/1968 Duda ..... B05B 11/3001 417/441
3,406,909 A 10/1968 Pfeiffer
3,452,905 A * 7/1969 Micallef ..... G01F 11/08 222/207
3,785,532 A * 1/1974 Cooprider ..... B05B 11/307 222/207

(Continued)

*Primary Examiner* — Patrick M. Buechner
(74) *Attorney, Agent, or Firm* — Steven M. Greenberg, Esq.; Shutts & Bowen LLP

(57) ABSTRACT

A pump for a vial intended to contain a cosmetic product. The pump includes a dosing chamber with a variable volume defined at least partially by a deformable element between an initial state and a deformed state. The pump further includes a guiding rod passing through the deformable element, the latter sliding along the rod when it undergoes a deformation. The deformable element includes an outlet lip delimiting an outlet orifice, surrounding a section of the rod, and bearing in a sealed manner against the rod or deviating from the rod according to the pressure in the chamber. A clamping edge extending from the rod maintains the outlet lip bearing in a sealed manner against the rod when the membrane is in the initial state thereof whatever the pressure in the chamber and whatever the pressure around the pump.

15 Claims, 8 Drawing Sheets

(56) References Cited

U.S. PATENT DOCUMENTS 4,088,248 A * 5/1978 Blake ..... B05B 11/3028 222/207
4,347,953 A * 9/1982 Bauer ..... B05B 1/083 222/207
5,046,644 A * 9/1991 Cater ..... B05B 11/3019 222/321.2
6,168,050 B1 * 1/2001 Battegazzore ..... B05B 11/303 222/207
6,755,327 B1 6/2004 Hazard et al.
10,493,475 B1 * 12/2019 Yang ..... B05B 11/00416
2005/0011913 A1 1/2005 Foster et al.
2009/0110576 A1 * 4/2009 Brouwer ..... B05B 11/3033 417/472
2010/0206910 A1 * 8/2010 Carta ..... B05B 11/3028 222/207
2011/0084099 A1 * 4/2011 Carta ..... B05B 11/007 222/207
2012/0024904 A1 * 2/2012 Doulin ..... B05B 11/3035 222/207
2013/0184677 A1 * 7/2013 Py ..... B05B 11/007 604/506
2013/0336824 A1 * 12/2013 Boes ..... B05B 11/3033 417/472
2014/0103071 A1 * 4/2014 Park ..... B05B 11/00416 222/207
2014/0124541 A1 * 5/2014 Mathiez ..... B65B 3/04 222/207
2014/0183229 A1 * 7/2014 Van Swieten ..... B05B 11/3097 222/256
2014/0197207 A1 * 7/2014 Pozzi ..... B05B 11/00444 222/189.09
2014/0239017 A1 * 8/2014 Von Schuckmann ..... B05B 11/309 222/207
2014/0346195 A1 * 11/2014 Doulin ..... B05B 11/3035 222/207
2015/0071801 A1 * 3/2015 De Regt ..... F04B 45/02 417/472
2016/0158780 A1 * 6/2016 Alluigi ..... B05B 11/3069 222/383.1
2016/0303601 A1 * 10/2016 Kang ..... B05B 11/3025
2016/0332180 A1 * 11/2016 Bruder ..... B05B 11/3053
2017/0246648 A1 8/2017 Rossignol
2019/0366376 A1 * 12/2019 Rossignol ..... B29C 45/0055
2020/0130002 A1 * 4/2020 Baumann ..... B05B 11/0044

* cited by examiner

[Fig.1]
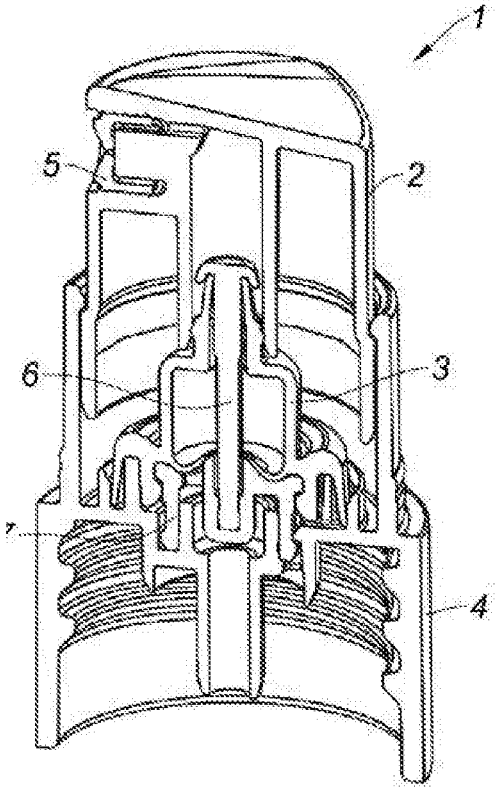

[Fig.2]
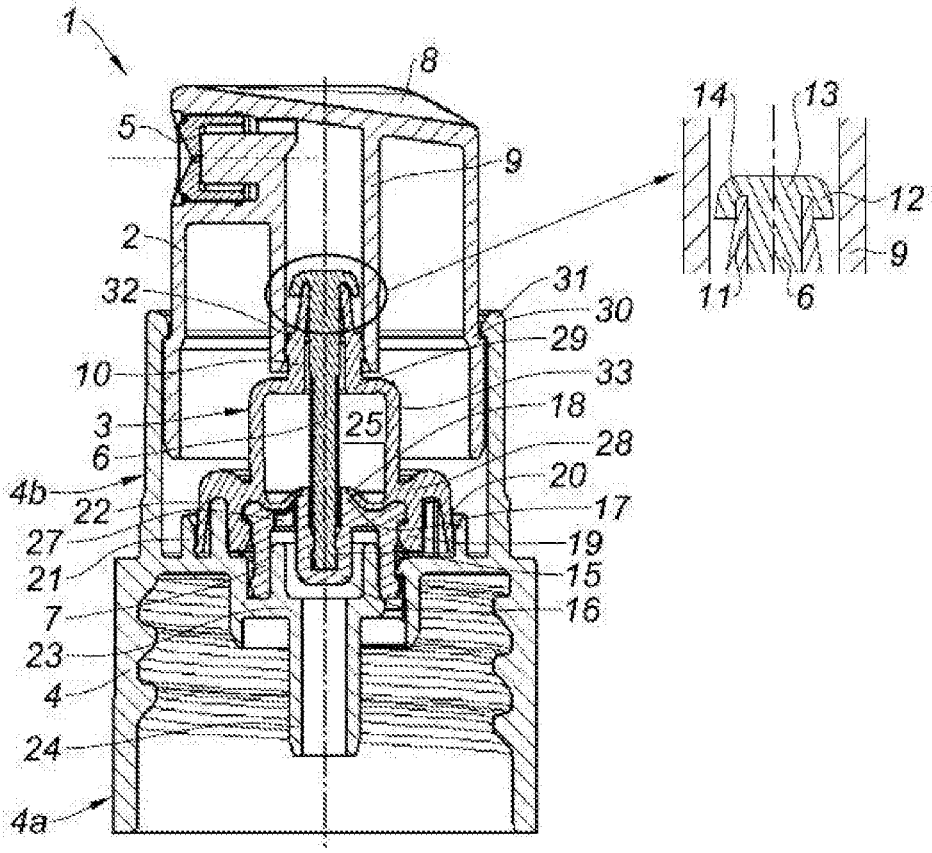

[Fig.3]
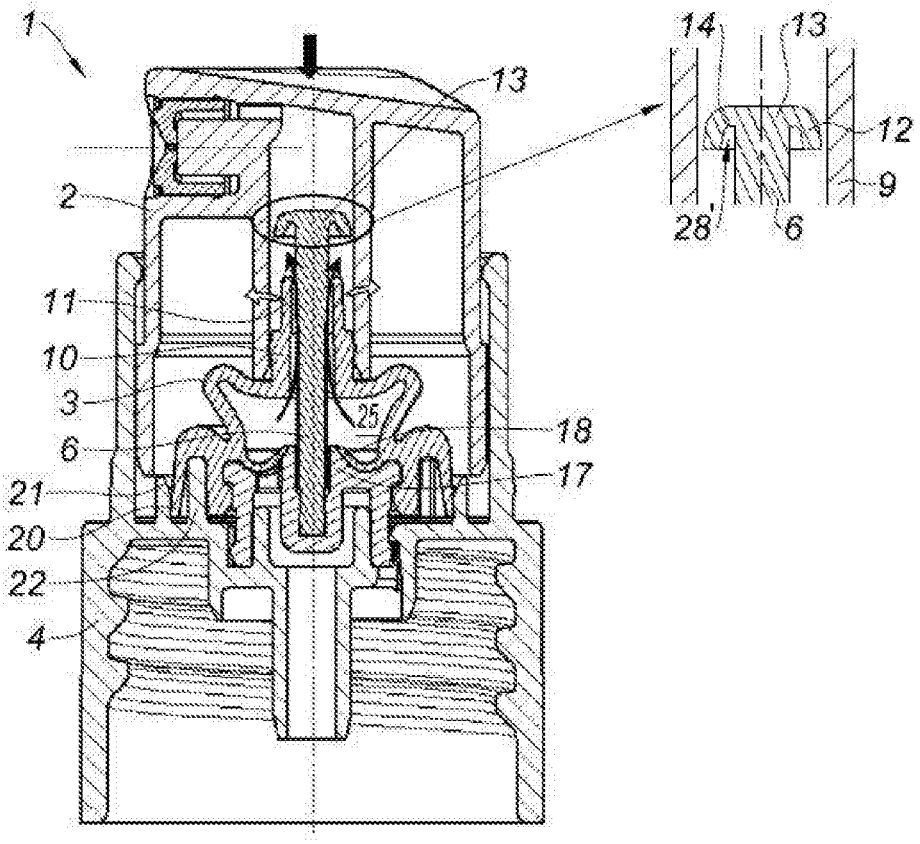

[Fig4]
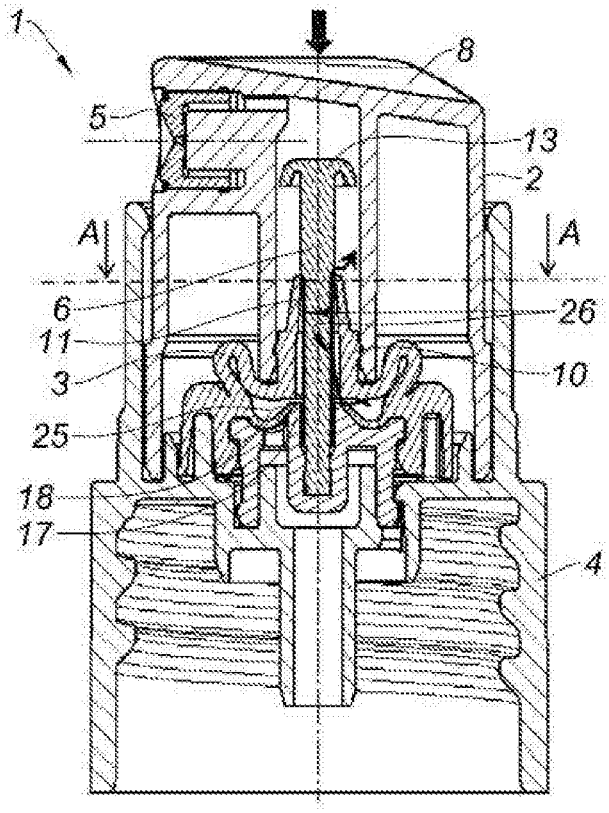
[Fig5]
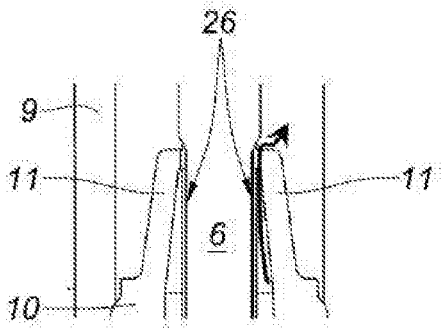
[Fig6]
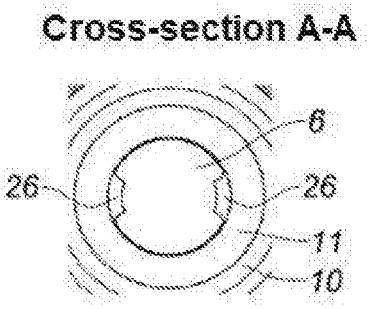

[Fig7]
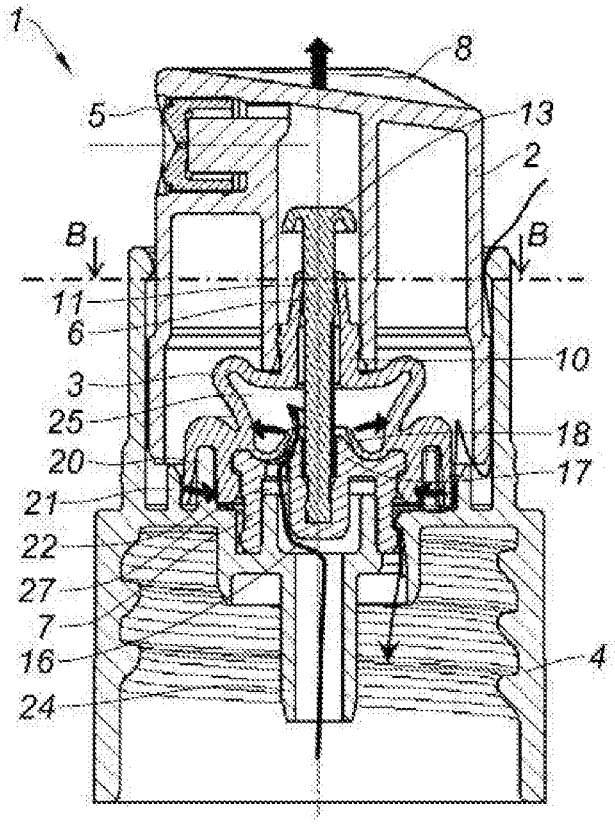
[Fig8]
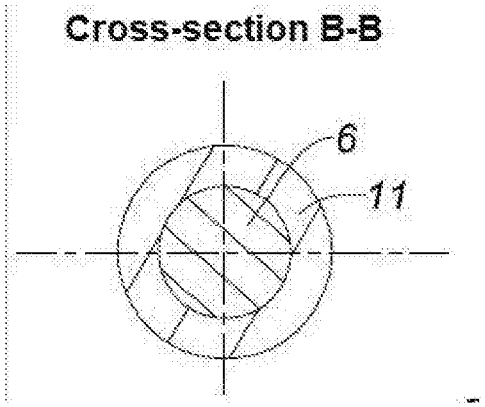

[Fig9]
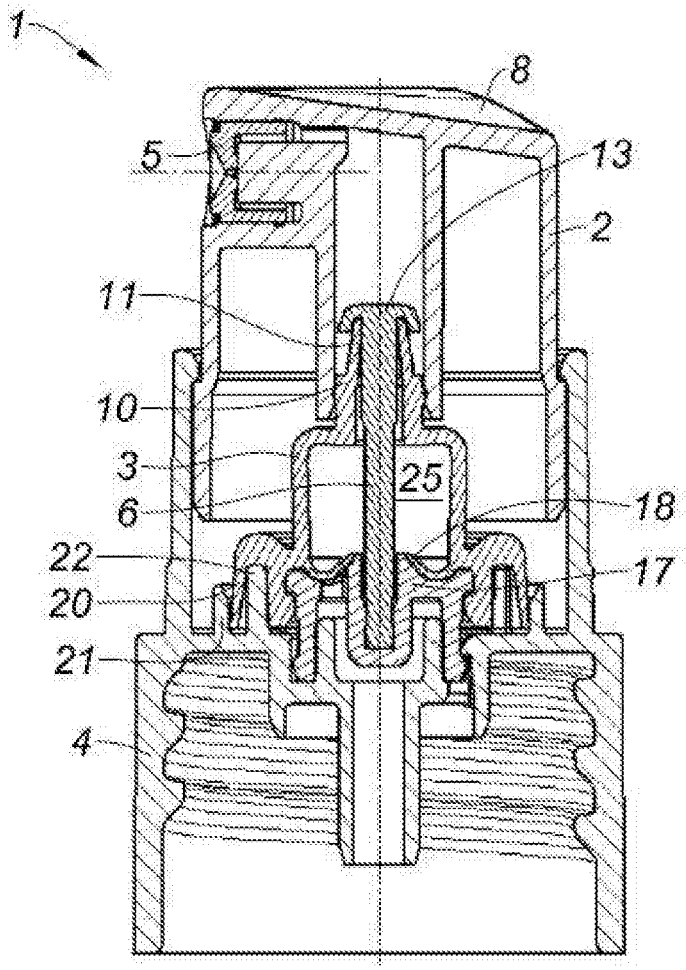

[Fig10]
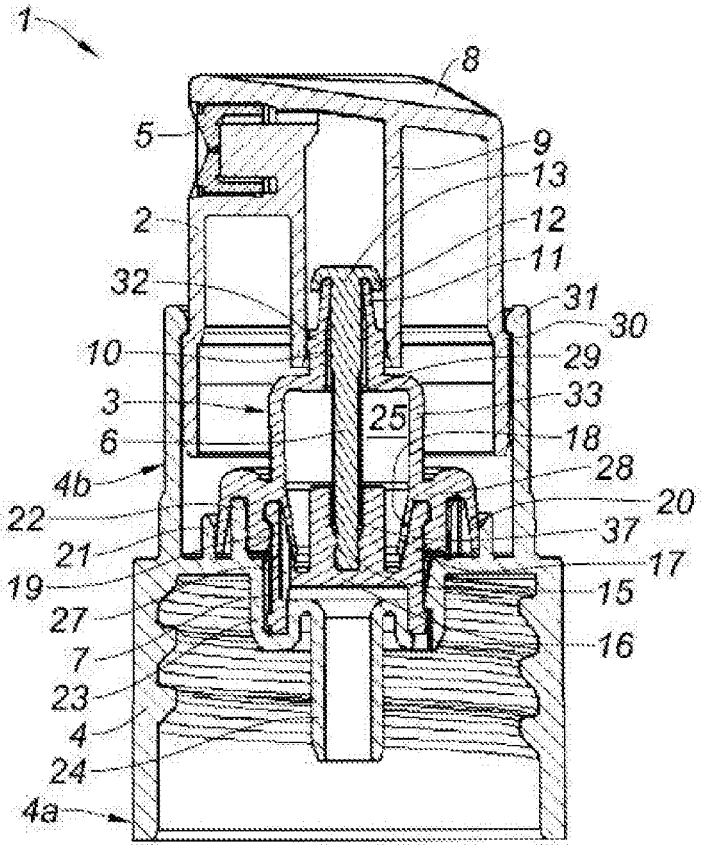

[Fig11]
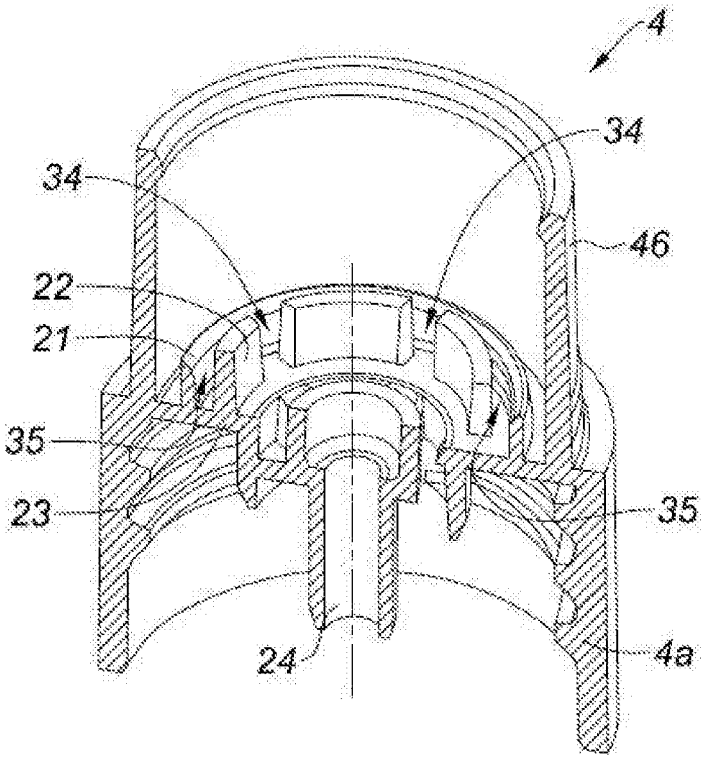

PUMP FOR COSMETIC PRODUCT VIAL, SEALED UNDER LOW-PRESSURE CONDITIONS

CROSS REFERENCE TO RELATED APPLICATIONS

This application claims priority under 35 U.S.C. § 119(a) to French patent application number 1874127, filed on Dec. 24, 2018, the entire teachings of which are incorporated herein by reference.

BACKGROUND OF THE INVENTION

Field of the Invention

The invention relates to a pump for a cosmetic product vial which remains sealed, even in case of low-pressure conditions. The invention also relates to a vial comprising such a pump.

Description of the Related Art

Certain cosmetic product vials are provided with a pump configured to suction the cosmetic product contained in the reservoir of the vial in order to dispense it, for example, by means of a nozzle or by a single opening. The product can thus be extracted or sprayed from the vial in order to make the application thereof possible. The pump is often actuated by means of a pushbutton on which the user exerts a pressure to trigger the functioning of the pump. A pump comprises, in particular, a dosing chamber, of which the volume varies to make it possible to suction the product in the chamber through an inlet orifice, when the volume increases, then the expulsion thereof outside of the chamber through an outlet orifice, when the volume of the chamber decreases. The product exits from the chamber in a dispensing conduit, which brings it to the opening or to the nozzle usually arranged on the pushbutton.

A pump equipped with a deformable membrane made of one single piece is known, of which the deformation is guided to ensure optimal folding, without needing to constrain the membrane in a compartment or give it a complex shape.

More specifically, fluid product dispensers comprising an elastic membrane pump and a rod passing through the membrane at the level of an elastic annular lip are known. This annular lip in contact with the rod forms an outlet valve for the pump, the rod forming the seat of the valve. In the idle position, the actuation button is maintained in a high abutment under the effect of the elasticity of the membrane, and the annular lip is in contact with the rod and ensures a sealed closing of the outlet valve. When the button is actuated, the volume of the dosing chamber of the pump decreases which leads to an increase in pressure of the fluid product within the chamber. The outlet valve is opened by deformation of the elastic lip and the product is dispensed.

The main disadvantage is that the outlet valve, in the idle position of the pump, does not offer satisfactory sealing under low pressure conditions, met for example during aircraft transportation. Under these conditions, the contact between the lip and the rod can be broken at least locally by deforming the lip and the product can be emptied for example into the handbag of the user. Generally, any depression conditions external to the vial risks causing the opening of the outlet valve.

SUMMARY OF THE INVENTION

The present invention aims to overcome the disadvantage stated above, by means of a device making it possible to neutralise the outlet valve during any depression condition external to the vial, so as to preserve an optimal sealing of the vial.

This aim is achieved, thanks to a pump for vial intended to contain a cosmetic product, said pump comprising a dosing chamber with a variable volume defined at least partially by a deformable element, the pump functioning by making the volume of the chamber vary by elastic deformation of a membrane of the deformable element between an initial state wherein the chamber has a maximum volume and a deformed state, wherein the volume of the chamber is minimal, the chamber being equipped with an inlet orifice and an outlet orifice for the product, the pump comprising a means for deforming the membrane configured to exert a pressure on the membrane, the pump further comprising a guiding rod passing through the deformable element, the deformable element sliding along the rod when the membrane undergoes said deformation, the deformable element comprising an outlet lip delimiting said outlet orifice and surrounding a section of the rod, said outlet lip bearing in a sealed manner against the rod or deviating from the rod according to the pressure in the chamber.

The pump is characterised mainly in that said rod comprises means for maintaining the outlet lip held sealed against the rod when the membrane is in the initial state thereof whatever the pressure in chamber and whatever the pressure around the pump.

A "lip" corresponds to a flexible portion, often slightly tapered, of a pad or a skirt, or any other element, which tends to be flattened against a surface to achieve sealing. The lip can be deformed, and in particular bend, so as to deviate from said surface under certain conditions, for example, when there are differences in pressure on either side of the lip, thus breaking the sealing.

The main idea of this invention consists of preventing the outlet lip from being able to be deformed from the moment when the membrane is in the initial state thereof, i.e. from the moment when the volume of the dosing chamber is maximal. The outlet lip is thus maintained bearing in a sealed manner against the rod, to avoid any deformation, whatever the pressure conditions. It can be, for example, an overpressure in the chamber, or it can be an external low pressure. In any case, the outlet lip is neutralised, and the outlet valve remains closed in a sealed manner Therefore, there is no longer a risk that the outlet lip is deviated from the rod and that the product is emptied involuntarily around the vial.

According to different embodiments of the invention, which can be taken together or separately:

a) said means for maintaining the outlet lip consisting of a clamping edge of the outlet lip, said clamping edge extending from the peripheral wall of the rod.
b) the clamping edge extends over the whole circumference of the rod.
c) the clamping edge is inclined or curved with respect to the rod so as to exert a pressure against the outlet lip.
d) the clamping edge has a surface for placing the outlet lip against the rod.
e) the clamping edge defines, with the rod, an annular recess, in which the outlet lip is inserted.
f) the outlet lip is inserted with force in the annular recess when the membrane is in its initial state.
g) the clamping edge is located at an end of the rod.

h) the clamping edge belongs to a head of the rod.

i) the deformable element has a longitudinal axis, the rod being arranged substantially about said longitudinal axis.

j) the membrane has a dome shape in the initial state.

k) the deformable element comprises a drum arranged at the top of the dome, the rod passing through the drum such that the drum slides along the rod during the deformation of the membrane.

l) the outlet lip is arranged on the drum.

m) the outlet orifice is located at the free end of the drum.

The invention also relates to a vial, in particular for cosmetic product, comprising a pump such as described above.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein:

FIG. 1 is a cross-sectional, perspective view of the elements of a pump according to the invention, with a first product inlet valve shape, FIG. 2 is a cross-sectional view according to FIG. 1, wherein the pump is in the idle position, FIG. 3 is a cross-sectional view illustrating a start of actuation of the pump, FIG. 4 is a cross-sectional view illustrating the pump in a maximum actuation position, FIG. 5 is an enlarged view of a portion of the guiding rod of the pump according to FIG. 4, FIG. 6 is a view of the guiding rod and of the membrane of the pump according to the cross-section A-A of FIG. 4, FIG. 7 is a cross-sectional view illustrating the pump when it passes from its maximum actuation position to its idle position, FIG. 8 is a view of the guiding rod of the membrane of the pump according to the cross-section B-B of FIG. 7, FIG. 9 is a cross-sectional view illustrating the return pump in its idle position, FIG. 10 is a cross-sectional view of a pump according to the invention with a second product inlet valve shape, FIG. 11 shows, cross-sectionally and in a perspective manner, a sleeve of the pump according to FIGS. 1 to 9.

DETAILED DESCRIPTION OF THE INVENTION

Below in the description, elements having an identical structure or similar functions are designated by the same references.

The invention relates to a pump 1 for a vial comprising a reservoir (not illustrated) intended to contain a cosmetic product. As illustrated in FIGS. 1 and 2, the pump 1 comprises a pushbutton 2, a deformable element 3 and a sleeve 4 acting as a collar.

The pushbutton 2 has the function of making it possible for the actuation of the pump 1 by a user. The pushbutton 2 here has a cylindrical body equipped with an opening for dispensing the product, wherein a nozzle 5 is located, and an upper support wall 8 on which the user exerts a pressure to actuate the pump 1, the pushbutton 2 being inserted into the sleeve 4 during the actuation. Any other pushbutton 2 could be used.

The pump 1 further comprises a dosing chamber 25 with a variable volume defined at least partially by the deformable element 3. The pump 1 functions by making the volume of the chamber 25 vary by elastic deformation of a membrane 33 of the deformable element 3 between an initial state represented in FIG. 2, in which the chamber 25 has a maximum volume and a deformed state represented in FIG. 4, in which the volume of the chamber 25 is minimal.

The chamber 25 has a shape having a longitudinal axis at the initial state. The membrane 33 here has a rounded dome shape comprising a circular nozzle 28 and a top 29. The deformable element 3 furthermore has a drum 10 surmounting the dome. The inner volume of the dome and of the drum 10 define the dosing chamber 25. The longitudinal axis of the chamber 25 passes substantially through the centre of the base 28, through the top 29 of the dome, and through the drum 10.

The deformable element 3 here is formed of one single elastic material, preferably a polymer material, for example a thermoplastic elastomer (TPE). It comprises more or less flexible zones according to the thicknesses thereof.

The sleeve 4 is mainly composed of an upper collar **4*b*, a lower collar 4*a*, and a support 23 on which the membrane 33 is positioned. In the embodiment presented here, an intermediate part 7 is fixed between the deformable element 3 and the support 23 of the sleeve 4. This intermediate part 7 is snap-fitted both to the support 23 and in the deformable element 3. More specifically, the base 28 of the deformable element 3 is provided with an inner edge 19 capable of being snap-fitted under a first outer edge of the intermediate part 7. Likewise, the support 23 is provided with an inner edge capable of being snap-fitted under a second outer edge of the intermediate part 7. Any other type of joining can be considered. It must be noted that the support 23 and the intermediate part 7** could only constitute one piece.

The upper collar **4*b* is used as a means for guiding the pushbutton 2, and extends from this support 23. Indeed, the cylindrical body of the pushbutton 2 slides inside the sleeve 4 and in particular, against the peripheral wall of the upper collar 4*b*. By measuring safety, to avoid any exiting of the pushbutton 2 with respect to the sleeve 4, the cylindrical body of the pushbutton 2 is provided with a circumferential shoulder 30 capable of abutting against an inner edge 31 localised at the free end of the peripheral wall of the upper collar 4*b* of the sleeve 4**.

From the support 23 of the sleeve 4, a lower collar **4*a* also extends, directed towards the reservoir. The inner surface of the peripheral wall of the lower collar 4*a* comprises a thread, for example in order to be able to be screwed on the collar of a reservoir. Snap-fitting of the sleeve 4** on the collar of the reservoir could also be considered. Any other type of joining can be considered.

The intermediate part 7 has a wall 17 on which the deformable element 3 rests at least partially. In particular, the deformable element 3 comprises an inlet lip 18 in the vicinity of the base 28 which rests on the wall 17. This wall 17 comprises at least one through bore 27 which makes it possible for the passage of the product from the reservoir to the dosing chamber 25. This bore 27 is covered by the inlet lip 18 of the deformable element 3 when the latter is mounted on the intermediate part 7.

This inlet lip 18 is flexible and has a tapered thickness with respect to the base 28, in order to have more flexibility. Thus, the inlet lip 18 can be raised to let the product enter into the chamber 25.

In the example shown in FIGS. 1 to 9, the wall 17 is obliquely oriented inwards from the sleeve 4, therefore even more so inwards from the deformable element 3, and forms a cone frustum in the proximity of the rod. The inlet lip 18 rests on the cone frustum, and thus rises back inside the dosing chamber 25.

However, it is quite conceivable that the wall 17 is flat, or is oriented differently, as this is, for example, the case in FIG. 10. In this FIG. 10, the wall 17 is inclined and forms a U-shaped well, limited near the axis of the pump by a wall 37 localised in the proximity of the rod, conversely the cone frustum. The inlet bore 27 is localised on an inner peripheral face of said well. The inlet lip 18 therefore covers this inclined wall 17, and covers the inlet bore 27 of the product to the dosing chamber 25. The presence of this well makes it possible to increase the volume of the dosing chamber 25 and consequently, the volume of the dose dispensed.

The support 23 of the sleeve 4 has a central funnel 24 inside or outside of which can be inserted a tube for suctioning product contained inside the reservoir. The product passes therefore inside this tube, then arrives in a space created between the intermediate part 7 and the support 23, then follows the path thereof until arriving at the level of the bore 27 made in the wall 17 of the intermediate part 7. When the inlet lip 18 is raised, as will be seen in the description below, the product can thus go back inside the dosing chamber 25.

The wall 17 and the inlet lip 18 form what is called an inlet valve for the product. The support wall 17 acts as a seat, and the inlet lip 18 consists of a deformable inlet lip capable of being flattened, or not, on the seat according to the pressure present inside the dosing chamber 25. When the inlet lip 18 is flattened on the wall 17, the dosing chamber 25 is sealed with respect to the reservoir containing the product.

According to the invention, the sleeve 4 is provided with a rod 6 for guiding the deformable element 3, which extends from the intermediate part 7. The rod 6 and the intermediate part 7 can consist of two different parts, or of a single part. In the embodiment shown the rod 6 and the intermediate part 7 are two different parts. A first end 15 of the rod 6 is fitted into a central socket 16 of the intermediate part 7.

In the embodiment represented, the upper collar 4*b*, the lower collar 4*a*, the support 23 and the funnel 24 form a single part termed sleeve 4. The rod 6 and the intermediate part 7 could also form part of this sleeve 4 made of one single part. Conversely, it could be an assembly of several parts to form the sleeve 4.

a) The rod 6 is arranged substantially about the longitudinal axis of the deformable element 3, which is coaxial with the central axis of the sleeve 4, as well as the central axis of the pushbutton 2. This guiding rod 6 passes through the deformable element 3, such that the latter slides along the rod 6 when it undergoes a deformation, the rod 6 passing through the chamber 25 substantially about the longitudinal axis of the chamber 25. A second end of the rod 6 is localised at the level of the end of the drum 10 of the deformable element 3. Indeed, the top 29 of the dome and the drum 10 form a through channel, which makes it possible for the rod 6 to pass through this channel and therefore through the deformable element 3. The upper end of the drum 10 comprises a tapered portion forming a flexible outlet lip 11 delimiting an outlet orifice for the fluid contained in the dosing chamber 25. This escape lip 11 surrounds a section of the rod 6 and is flattened against the rod 6.

This rod 6 has the function of guiding the membrane 33 when it passes from the initial state to the deformed state, then from the deformed state to the initial state. The membrane 33 is thus configured to be able to fold the top 29 thereof to the base 28 thereof, the drum 10 of the deformable element 3 is also moved towards the base 28 along the rod 6. Thanks to the rod 6, the membrane 33 remains centred about the longitudinal axis of the sleeve 4. Thus, the risk of an incorrectly controlled folding of the membrane 33 is thus avoided.

The outlet lip 11 and the rod 6 form what is called an outlet valve for the fluid product. The seat of this valve is constituted by the body of the rod 6 on which the outlet lip 11 is flattened. When an increase in pressure is produced within the dosing chamber 25, the outlet valve is opened by elastic deformation of the outlet lip 11 and the product can thus escape from the dosing chamber 25 to arrive up to the nozzle 5 in order to be dispensed. More specifically, the deformation of the outlet lip 11 induces the creation of a few spaces between the rod 6 and the lip 11 through which the fluid product can pass and therefore escape from the dosing chamber 25.

When low pressure occurs all around the pump 1, for example when it is located in the mountains or in a storage hold of an aircraft, the difference in pressure between the outside and inside of the dosing chamber 25 increases and such that there is an overpressure phenomenon which is ultimately created, which leads to the deformation of the outlet lip 11 and therefore a flow of product via the outlet valve, while this is not desired by the user. This overpressure phenomenon within the pump can also occur when the dispenser is left in the sun.

To avoid any deformation of the outlet lip 11 when the pump 1 is in the idle position, i.e. when the volume of the chamber 25 is maximal, the rod 6 is provided with means for maintaining the outlet lip 11. These maintaining means consist of a clamping edge 12 of the outlet lip 11, extending from the second end of the rod 6. More specifically, this second end of the rod 6 is equipped with a rod head 13 from which extends a clamping edge 12 curved in the direction of the first end 15 of the rod 6, so as to create an annular recess 28' between the rod 6 body and the clamping edge 12. The outlet lip 11 of the deformable element 3 can thus be inserted inside this annular recess 28'. When the dosing chamber 25 has a maximum volume, the membrane 33 is deployed to the maximum, and the outlet lip 11 is inserted with force into the recess 28'. The clamping edge 12 is inclined or curved so as to exert a force for placing the outlet lip 11 against the body of the rod 6. More specifically, the inner surface of the clamping edge 12 comes into contact with the outer surface of the outlet lip 11 to press the latter against the rod 6 body. In this manner, even in case of depression outside of the vial, the outlet lip 11 cannot be deformed as it is completely surrounded and maintained inside the recess 28' thanks to the clamping edge 12.

This clamping edge 12 extends over the whole circumference of the rod 6 so as to surround all of the outlet lip 11.

Preferably, the thickness of the outlet lip 11 is greater than the width of the recess 28', thus the outlet lip 11 is inserted by force without reaching the bottom 14 of the recess 28'. This makes it possible to ensure a good sealing.

To deform the deformable element 3, the pump 1 comprises a deformation means arranged outside of the chamber 25 and configured to exert a pressure on the membrane 33 when the pushbutton 2 is actuated. This deformation means is a dispensing conduit 9 having an open end in contact with the membrane 33. The dispensing conduit 9 here forms part of the pushbutton 2, the conduit 9 extending inside the pushbutton 2 from the inner face of the upper wall 8. The dispensing conduit 9 has the function of bringing the product exiting from the dosing chamber 25 up to the opening and the nozzle 5 of the pushbutton 2. The dispensing conduit 9 is in sealed contact with the deformable element 3. For this, the drum 10 is inserted in the dispensing conduit 9, the conduit 9 resting on the membrane 33. The drum 10 is furthermore equipped with an outer bulge 32 which makes it possible, on the one hand, to block in the conduit 9, and on the other hand, to ensure sealing in contact with the dispensing conduit 9. The bulge 32 goes around the drum 10, here at the junction with the membrane 33, and is sized substantially to the dimensions of the open end of the dispensing conduit 9.

Below, the functioning of the pump 1 will be described.

In FIG. 2, the pump 1 is in the idle position. In this position, the pump 1 is sealed. Indeed, the elastic reaction of the pre-constrained membrane 33 tends to push the outlet lip 11 upwards and wedge it under the rod 6 head, i.e. under the clamping edge 12. This outlet lip 11 is thus located clamped in the rod 6 head. The product outlet valve is thus closed and sealed. The dosing chamber 25 has a maximum volume. The circumferential shoulder 30 of the pushbutton 2 is abutted against the inner edge 31 of the peripheral wall of the upper collar 4*b* of the sleeve 4. The inlet lip 18 of the deformable element 3 rests in a sealed manner on the wall 17 of the intermediate part 7. The product inlet valve is thus closed.

In FIG. 3, a user presses on the pushbutton 2. The pushbutton 2 thus slides inside the sleeve 4 and is directed towards the support 23 of the sleeve 4. In the course thereof, the pushbutton 2 drives the descent of the drum 10 from the deformable element 3 in the direction of the support 23. The outlet lip 11 slides along the rod 6 and is put at a distance from the rod head 13. The outlet lip 11 is therefore no longer engaged with the clamping edge 12. The dispensing conduit 9 of the pushbutton 2 bears in parallel on the membrane 33 so as to deform it by folding it inwards. The top of the dome of the membrane 33 is thus flattened. The volume of the dosing chamber 25 thus starts to decrease and the pressure increases in the dosing chamber 25. This overpressure in the dosing chamber 25 leads to the deformation of the outlet lip 11, which is deviated from the rod 6 beyond a threshold constraint, which is represented by small arrows. The pressurised product in the dosing chamber 25 thus escapes via the outlet valve and enters into the dispensing conduit 9 of the pushbutton 2 until arriving at the dispensing nozzle 5, which is represented by large arrows. The diffusion of the product is thus conditioned to a minimum pressure to arrive at the nozzle 5.

In the end position, as illustrated in FIG. 4, the cylindrical body of the pushbutton 2 arrives abutted against the support 23 of the sleeve 4, while the dispending conduit 9 has deformed the membrane 33 to the maximum, and the volume of the dosing chamber 25 is minimal. A maximum amount of product contained in the chamber 25 exits via the outlet valve. Since there is no longer pressure in the dosing chamber 25, the outlet lip 11 is again flattened against the rod 6 body.

It is possible that residual air is contained in the dosing chamber 25. This air can have been trapped in the reservoir at the moment when the dispensing system is fixed on the product-filled reservoir, if this is an airless pump, or this air can come from an airless system, if it is an atmospheric pump, i.e. with air in the reservoir, or this air can be present in the suctioning tube before a first use.

In this low position such as illustrated in FIG. 4, the residual air is compressed in the dosing chamber 25, but without creating a sufficient overpressure at the opening of the outlet valve to make this residual air exit. A draining system therefore has been provided in the form of at least one axial decompression kerf 26 which extends along a section of the rod 6. In this case, this is the section against which the outlet lip 11 is in contact when the membrane 33 is compressed to the maximum and that the pushbutton 2 is abutted against the support 23 of the sleeve 4. In the example presented, there are two diametrically opposed axial kerfs 26, as is illustrated in particular in FIGS. 5 and 6. At the level of these axial kerfs 26, the outlet lip 11 is thus not in contact with the rod 6 body, in this case with the bottom of the kerf 26, and a small space is created between the outlet lip 11 and the bottom of the kerf 26, space through which the residual air from the dosing chamber 25 can escape.

These axial kerfs 26 can be replaced by axial ridges. In this case, the outlet lip 11 is put at a distance from the rod body when it passes above a ridge. A space is thus created between the outlet lip 11 and the rod body to the right and to the left of the ridge.

One single decompression kerf 26 is sufficient to make it possible for air to escape. It is also possible to consider two, three, four, or n kerfs 26.

Each axial kerf 26 extends over an axial length at least greater than the length of the outlet lip 11 of the outlet valve, such that air can enter into the kerf 26. It is also essential that these kerfs 26 open directly into the dosing chamber 25 at the level of the drum 10 of the deformable element 3. It must be noted that the drum 10 of the deformable element 3, outside of the outlet lip 11, has an inner diameter greater than the outer diameter of the rod 6. Preferably, each axial kerf 26 extends over an axial length corresponding to the total length of the drum 10 of the deformable element 3.

When the pump 1 is in the maximum activation position, the outlet lip 11 of the outlet valve is located around the decompression kerfs 26 of the rod 6. There is thus a sealing break and a fall in pressure in the dosing chamber 25, therefore air escapes, as is illustrated by the arrow. This can also be produced in the initiation phase of the pump 1.

In the maximum activation position, the dosing chamber 25, initially over-pressured, is arranged in communication with the atmosphere. The pressure in the dosing chamber 25 falls, which has the effect of immediately stopping the end of dispensing product. Thus, avoiding the ends of dispensing, comprising large drops, provided by conventional dispensing systems.

In FIG. 7, the user releases the pressure exerted on the pushbutton 2, and the latter thus starts the rising thereof towards the idle position thereof, thanks to the elastic reaction of the membrane 33. The outlet lip 11 is also pushed by the membrane 33 in the direction of the rod 6 head. This small course of the outlet lip 11, between a low position in a section of the rod 6 with decompression kerfs 26 and an intermediate position in a section of the rod 6, smooth and round without any kerf, makes it possible for a slight suction at the outlet of the nozzle 5, and to avoid a drop from forming at the level of the outlet of the nozzle 5.

This rising of the membrane 33 and from the drum 10 leads to the increase in volume of the dosing chamber 25, which leads to an inner low pressure within the dosing chamber 25. This low pressure, associated with the thrust of the product from the reservoir, causes the opening of the inlet valve of the product. In this case, the inlet lip 18 moves away from the wall 17 (as illustrated by small arrows), and the product can thus pass from the reservoir to the dosing chamber 25 through the bore 27 of the intermediate part 7 (as illustrated by a large arrow). This suctioning of the product is followed until the outlet lip 11 arrives abutted at the bottom 14 of the recess 28' of the rod 6 head. The outlet lip 11 is thus again in the initial position and surrounded around the rod 6 thanks to the clamping edge 12. In FIG. 8, it can be seen, that the outlet lip 11 is in sealed contact with the rod 6. The product outlet valve is thus closed during the rising of the pushbutton 2.

The deformable element 3 is equipped with a lip for recovering localised air 20 in the vicinity of the base 28, and which engages with the support 23 of the sleeve 4. More specifically, the support 23 comprises an outer ring 21 and an inner ring 22, which surrounds the intermediate part 7, as is illustrated in FIG. 11, the inner ring 22 is discontinuous so as to form passages 34. An annular gap 35 is formed between the two rings 21, 22. The lip for returning air 20 from the deformable element 3 is housed in this gap 35 and is capable of being flattened against the inner surface of the outer ring 21, so as to form a valve for returning air, the outer ring 21 thus forming a seat against which the lip for returning air 20 is flattened sealed. This lip 20 is tapered and is therefore flexible. The placing of the lip for returning air 20 against the outer ring 21 makes it possible to achieve a sealing to air between the outside of the reservoir and the inside of the reservoir.

During the rising of the pushbutton 2, the product inlet within the dosing chamber 25 leads to a depression within the reservoir containing the product, which causes a suctioning of air permitted via this valve for returning air. In particular, the suctioning of air will tend to deviate the lip for returning air 20 with respect to the outer ring 21 and to get it closer to the inner ring 22 (as illustrated by small arrows). The sealing is thus broken and air can pass between the lip for returning air 20 and the outer ring 21 then in the passages 34 of the inner ring 22, then between the intermediate part 7 and the support of the sleeve 4, until arriving within the reservoir. Air initially comes from the outside of the vial and passes between the pushbutton 2 and the sleeve 4 before arriving at the level of the valve for returning air. This conveyance is illustrated by a large arrow in FIG. 7.

In FIG. 9, the pump 1 is returned into the initial idle state thereof, as in FIG. 2. The elastic reaction of the pre-constrained membrane 33 tends to push the outlet lip 11 to the top and to wedge it under the rod 6 head. This is thus located clamped in the rod 6 head. The depression being stopped inside the dosing chamber 25, the product inlet valve is closed, as the inlet lip 18 is re-flattened on the bore 27 of the intermediate part 7, through the intrinsic elasticity of the TPE material of the deformable element 3.

The lip for returning air 20 comes back into place against the outer ring 21. The valve for returning air is thus closed and the reservoir is sealed to air. The dosing chamber 25 contains a new product dose ready to be delivered.

The inlet lip, the outlet lip, and the lip for returning air all have a collar shape, since they extend peripherally into the deformable element which is a revolution part.

The configurations shown in the figures cited are only possible examples, not at all limiting, of the invention which surrounds, on the contrary, the shape and design variants in the scope of a person skilled in the art.

I claim:

1. A pump for a vial adapted to contain a cosmetic product, said pump having a dosing chamber with a variable volume defined at least partially by a deformable element, the pump functioning by making the volume of the chamber vary by elastic deformation of a membrane of the deformable element between an initial state, wherein the chamber has a maximum volume and a deformed state, wherein the volume of the chamber is minimal, the chamber being equipped with an inlet orifice and with an outlet orifice for the product, the pump comprising:

means for deforming the membrane configured to exert a pressure on the membrane, a guiding rod passing through the deformable element, the deformable element sliding along the rod when the membrane undergoes said deformation, the deformable element having an outlet lip delimiting said outlet orifice and surrounding a section of the rod, said outlet lip bearing in a sealed manner against the rod or deviating from the rod according to the pressure in the chamber, wherein said rod has means for maintaining the outlet lip bearing in a sealed manner against the rod when the membrane is in the initial state thereof whatever the pressure in the chamber and whatever the pressure around the pump.

2. The pump according to claim 1, wherein said means for maintaining the outlet lip consist of a clamping edge of the outlet lip, said clamping edge extending from a peripheral wall of the rod.

3. The pump according to claim 2, wherein in that the clamping edge extends over the whole circumference of the rod.

4. The pump according to one of claim 2, wherein the clamping edge is inclined or curved with respect to the rod so as to exert a pressure against the outlet lip.

5. The pump according to one of claim 2, wherein in the clamping edge has a surface for placing the outlet lip against the rod.

6. The pump according to claim 2, wherein the clamping edge defines, with the rod, an annular recess wherein the outlet lip is inserted.

7. The pump according to claim 6, wherein the outlet lip is inserted by force into the annular recess when the membrane is in the initial state thereof.

8. The pump according to claim 2, wherein the clamping edge is located at an end of the rod.

9. The pump according to claim 2, wherein the clamping edge belongs to a head of the rod.

10. The pump according to claim 9, wherein the deformable element has a longitudinal axis, the rod being arranged along said longitudinal axis.

11. The pump according to claim 1, wherein the membrane has a dome shape in the initial state.

12. The pump according to claim 11, wherein the deformable element comprises a drum arranged at the top of the dome, the rod passing through the drum such that the drum slides along the rod during the deformation of the membrane.

13. The pump according to claim 12, wherein the outlet lip is arranged on the drum.

14. The pump according to claim 13, wherein the outlet orifice is located at a free end of the drum.

15. A vial for holding a cosmetic product, the vial comprising:

a container for holding a cosmetic product; and a pump, said pump having a dosing chamber with a variable volume defined at least partially by a deformable element, the pump functioning by making the volume of the chamber vary by elastic deformation of a membrane of the deformable element between an initial state, wherein the chamber has a maximum volume and a deformed state, wherein the volume of the chamber is minimal, the chamber being equipped with an inlet orifice and with an outlet orifice for the product, the pump comprising:

means for deforming the membrane configured to exert a pressure on the membrane, a guiding rod passing through the deformable element, the deformable element sliding along the rod when the membrane undergoes said deformation, the deformable element having an outlet lip delimiting said outlet orifice and surrounding a section of the rod, said outlet lip bearing in a sealed manner against the rod or deviating from the rod according to the pressure in the chamber, wherein said rod has means for maintaining the outlet lip bearing in a sealed manner against the rod when the membrane is in the initial state thereof whatever the pressure in the chamber and whatever the pressure around the pump.

* * * * *